US006840268B2

(12) United States Patent
Kennedy et al.

(10) Patent No.: US 6,840,268 B2
(45) Date of Patent: Jan. 11, 2005

(54) HIGH-PRESSURE CONNECTOR HAVING AN INTEGRATED FLOW LIMITER AND FILTER

(75) Inventors: Lawrence Charles Kennedy, Bingham Farms, MI (US); Ronald Michael Tkac, Brighton, MI (US); Haoran Hu, Novi, MI (US)

(73) Assignee: Detroit Diesel Corporation, Detroit, MI (US)

( * ) Notice: Subject to any disclaimer, the term of this patent is extended or adjusted under 35 U.S.C. 154(b) by 238 days.

(21) Appl. No.: 10/154,379

(22) Filed: May 23, 2002

(65) Prior Publication Data

US 2003/0217726 A1 Nov. 27, 2003

(51) Int. Cl.[7] ..... F02M 39/00
(52) U.S. Cl. ..... 137/504; 239/533.3; 123/446
(58) Field of Search ..... 239/533.3, 533.4, 239/533.5, 510; 137/504, 509, 517, 544; 123/446

(56) References Cited

U.S. PATENT DOCUMENTS 3,854,497 A * 12/1974 Rosenberg ..... 137/557
5,519,187 A 5/1996 Hinkle ..... 219/270
5,769,391 A 6/1998 Noller et al. ..... 251/129.21
5,913,332 A * 6/1999 Fulford ..... 137/544
5,934,252 A 8/1999 Hafner et al. ..... 123/468
5,957,390 A 9/1999 Romann ..... 239/397.5
6,067,963 A * 5/2000 Oi et al. ..... 123/458
6,148,805 A 11/2000 Bartley et al. ..... 123/568.28
6,196,259 B1 * 3/2001 Weber ..... 137/504

* cited by examiner

*Primary Examiner*—Harry B. Tanner
(74) *Attorney, Agent, or Firm*—Bliss McGlynn, P.C.

(57) ABSTRACT

A high-pressure connector for a fuel injection system including an elongated body having an inlet that is in fluid communication with a source of high-pressure fuel, an outlet in fluid communication with the inlet of a fuel injector and a fuel passage extending therebetween. A filter is supported within the fuel passage and acts to filter particulates from the high-pressure fuel. A fuel flow limiter is supported within the fuel passage and is operable to provide predetermined quantities of fuel to pass between the inlet and the outlet at each injection event during normal operation of the combustion chamber serviced by the injector and to automatically terminate fuel flow through the connector in the event of a malfunction at the combustion chamber.

17 Claims, 6 Drawing Sheets

HIGH-PRESSURE CONNECTOR HAVING AN INTEGRATED FLOW LIMITER AND FILTER

BACKGROUND OF THE INVENTION

1. Technical Field

The present invention relates, generally, to a high-pressure connector used in a fuel injection system and, more specifically, to fuel injection system including a high-pressure connector having an integrated flow limiter and filter.

2. Description of the Related Art

Fuel injection systems are employed in connection with internal combustion engines. Generally speaking, internal combustion engines include an engine block and a cylinder head that is mounted to the engine block. A rocker cover is supported upon the cylinder head. The engine block includes a plurality of cylinders. A piston is reciprocally supported in each one of the cylinders. The pistons and cylinders cooperate to define combustion chambers. In turn, the cylinder head supports a number of components that are associated with each piston/cylinder arrangement. More specifically, the head supports intake and exhaustive valves, and valve train components such as rocker arm assemblies or camshafts that are employed to actuate the intake and exhaustive valves. In addition to these components, internal combustion engines may also include fuel injection systems for delivering high-pressure fuel to the combustion chamber.

To this end, fuel injected internal combustion engines sometimes employ a low-pressure pump to deliver fuel from a fuel tank to a high-pressure pump. The high-pressure pump accepts low-pressure fuel from the low-pressure pump, elevates the pressure of the fuel and delivers high-pressure fuel to a fuel rail through a supply line. In turn, the fuel rail distributes the high-pressure fuel to injectors via jumper lines and high-pressure connectors. The high-pressure connectors are in fluid communication with fuel injectors that are often supported by the head and associated with each piston/cylinder arrangement. The fuel injectors deliver predetermined quantities of high-pressure fuel into the combustion chambers at timed intervals. The fuel is combusted to drive the piston in reciprocating manner. Collectively, the pistons drive a crankshaft or similar mechanism, typically supported by the engine block. Power generated by the engine is communicated to a transmission, a generator, or any other device that may be driven by the engine.

In addition to these components, fuel injection systems known in the related art often employ flow limiters that act to supply predetermined amounts of the fuel to an associated injector for each injection event. Flow limiters of the type known in the related art also serve to interrupt fuel flow from the fuel rail to each injector in the event of a failure at the injector. A flow limiter is employed in connection with each injector and is typically supported between the fuel rail and the jumper line associated with each injector.

Fuel injection systems also include fuel filters that are employed to reduce or eliminate unwanted particulate matter that may be found in the fuel. Such unwanted particulate matter can cause fouling of the fuel injector and other components of the fuel injection system and can increase undesirable emissions associated with the internal combustion engine. High-pressure connectors, fuel flow limiters and fuel filters of the type commonly employed in the related art are typically separate components disposed at distinct locations within the fuel injection system. Thus, high-pressure connectors, fuel flow limiters and fuel filters are separately engineered components having different mounting requirements and conditions and collectively add to the space necessary to accommodate the fuel injection system.

While the high pressure fuel injection systems employing high-pressure connectors, flow limiters and filters of the type known in the related art have generally worked for their intended purposes, there remains a need to reduce the number of components that are used in any given system and to simplify existing components. Simplification and reduction of the number of components reduces costs, improves manufacturing processes, improves reliability, and saves time.

SUMMARY OF THE INVENTION

The present invention overcomes these disadvantages in the prior art in a high-pressure connector for a fuel injection system used in connection with an internal combustion engine having combustion chambers serviced by fuel injectors. More specifically, the high-pressure connector of the present invention includes an elongate body having an inlet that is in fluid communication with a source of high-pressure fuel, an outlet in fluid communication with the inlet to the fuel injector and a fuel passage extending between the inlet and the outlet for providing a flow path for high-pressure fuel therebetween. A filter is supported within the fuel passage and acts to filter particulates from the high-pressure fuel. The high-pressure connector of the present invention also includes a fuel flow limiter that is supported within the fuel passage and is operable to provide predetermined quantities of fuel to pass between the inlet and the outlet through the fuel passage at each injection event during normal operation of the combustion chamber serviced by the injector. In addition, the fuel flow limiter is further operable to automatically terminate fuel flow between the inlet and the outlet to the injector in the event of a malfunction at the combustion chamber.

The present invention incorporates the functionality of a high-pressure connector along with a fuel flow limiter and fuel filter in a single component of the fuel injection system. In this way, the high-pressure connector of the present invention results in a reduction of the number of components employed in the fuel injection system which results in a concomitant reduction and simplification of the mounting requirements necessary to employ the fuel injection system. In addition, the high-pressure connector of the present invention reduces the amount of space necessary to accommodate the fuel injection system and results in an overall simplification of the fuel injection system.

BRIEF DESCRIPTION OF THE DRAWINGS

Other advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
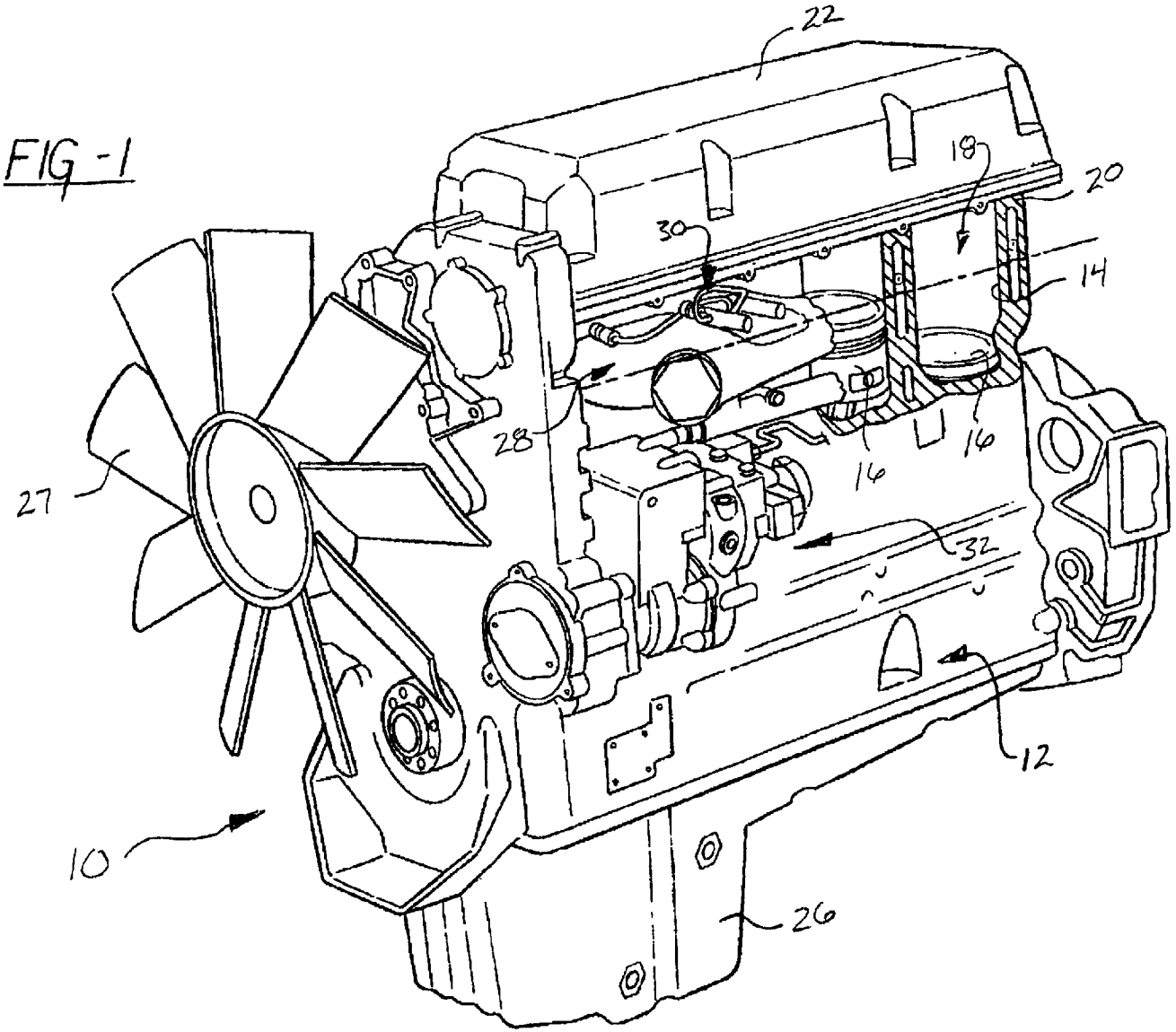
FIG. 1 is a partially cut-away perspective view of an internal combustion engine.
Figure 3:
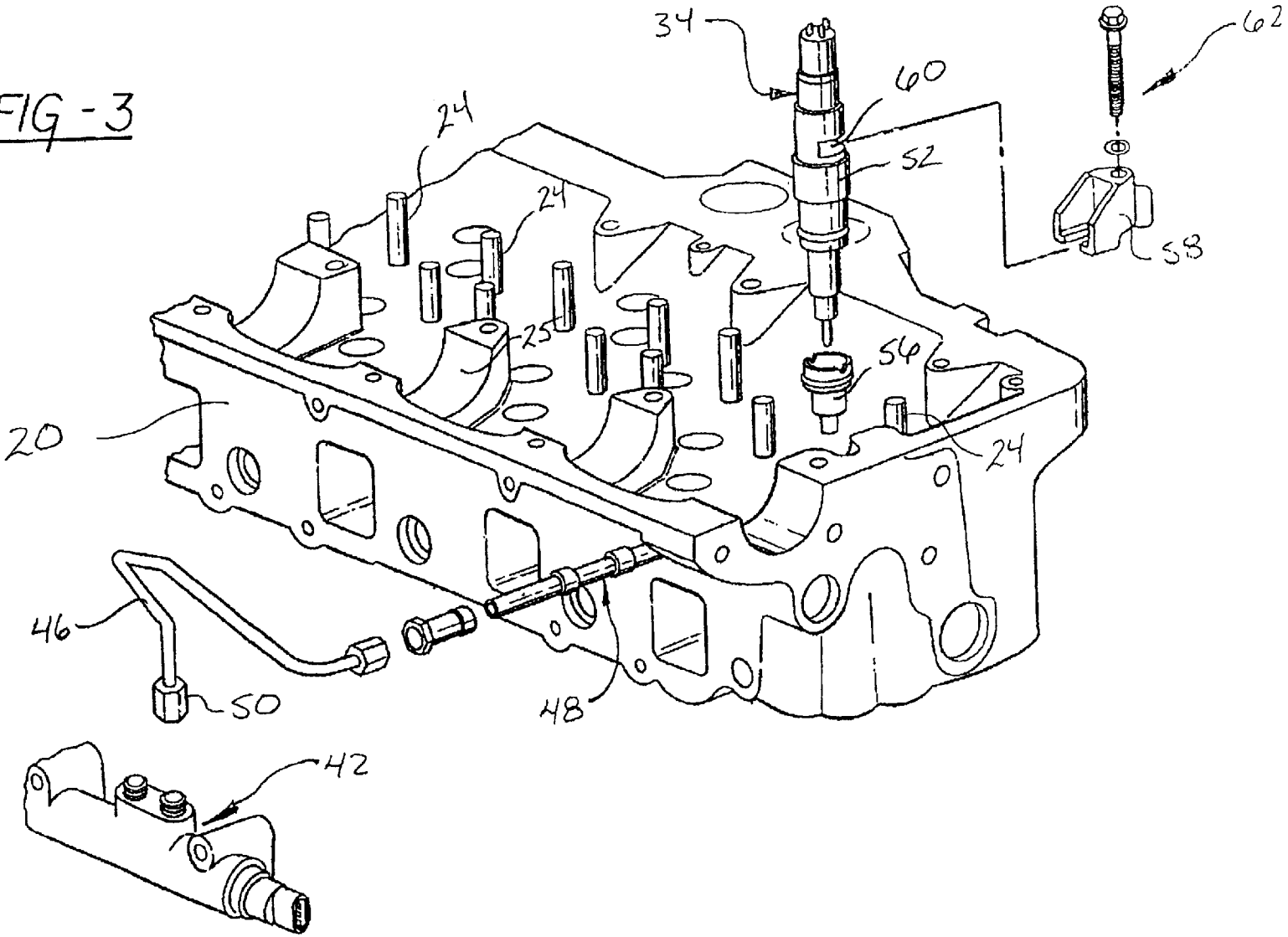
FIG. 3 is a partial assembly view of a portion of the cylinder head and fuel injection system of the present invention.

The fuel injection system including the high pressure connector of the present invention is shown in connection with an internal combustion engine, generally indicated at 10 in FIG. 1, where like numerals are used to indicate like structure throughout the figures. The internal combustion engine 10 includes an engine block, generally indicated at 12 having a plurality of cylinders 14 with a corresponding piston 16. The pistons 16 are reciprocally supported in each one of the cylinders 14 so as to define combustion chambers, generally indicated at 18, within the engine block 12. A cylinder head 20 is mounted to the engine block 12. In addition, a rocker cover 22 is supported upon the cylinder head 20. The cylinder head 20 supports a number of components that are associated with each piston/cylinder arrangement. For example, the cylinder head 20 may support intake and exhaust valves as evidenced by the valve guides 24 illustrated in FIG. 3, valve train components such as rocker arm assemblies or cam shafts that are employed to actuate the intake and exhaust valves, as commonly known in the art. To this end, the cylinder head 20 may have cradles 25 formed therein to support bearings on camshafts associated with the valve train. An oil pan 26 is mounted to the underside of the engine block 12 and serves as a sump for lubricating oil for the internal combustion engine. A cooling fan 27 is operatively driven by the engine 10 in a manner commonly known in the art. An intake manifold, generally indicated at 28, provides fresh intake air to the combustion chambers 18 via the cylinder head 20 as is commonly known in the art. In addition, the internal combustion engine 10 may include other components such as EGR valves, an exhaust manifold, a turbo-charger, sensors, and a number of other related components not shown here but also commonly known in the art.

The combustion chambers 18 defined by the pistons and cylinders may be arranged in any convenient manner such as inline, or in a V-shaped configuration. Thus, while the engine illustrated in FIG. 1 has an inline cylinder arrangement, those having ordinary skill in the art will appreciate from the description that follows that the present invention may be employed in conjunction with an internal combustion engine having a straight four, straight six, V-6, V-8, V-12 cylinder arrangements, or the like. Furthermore, those having ordinary skill in the art will appreciate that the number and particular arrangement of the combustion chambers of the internal combustion engine 10 form no part of the present invention. The internal combustion engine 10 may be either a spark ignition or compression ignition (diesel) engine. However, in the preferred embodiment contemplated by the inventors herein, the present invention is particularly adapted for use with a diesel engine.

Figure 2:
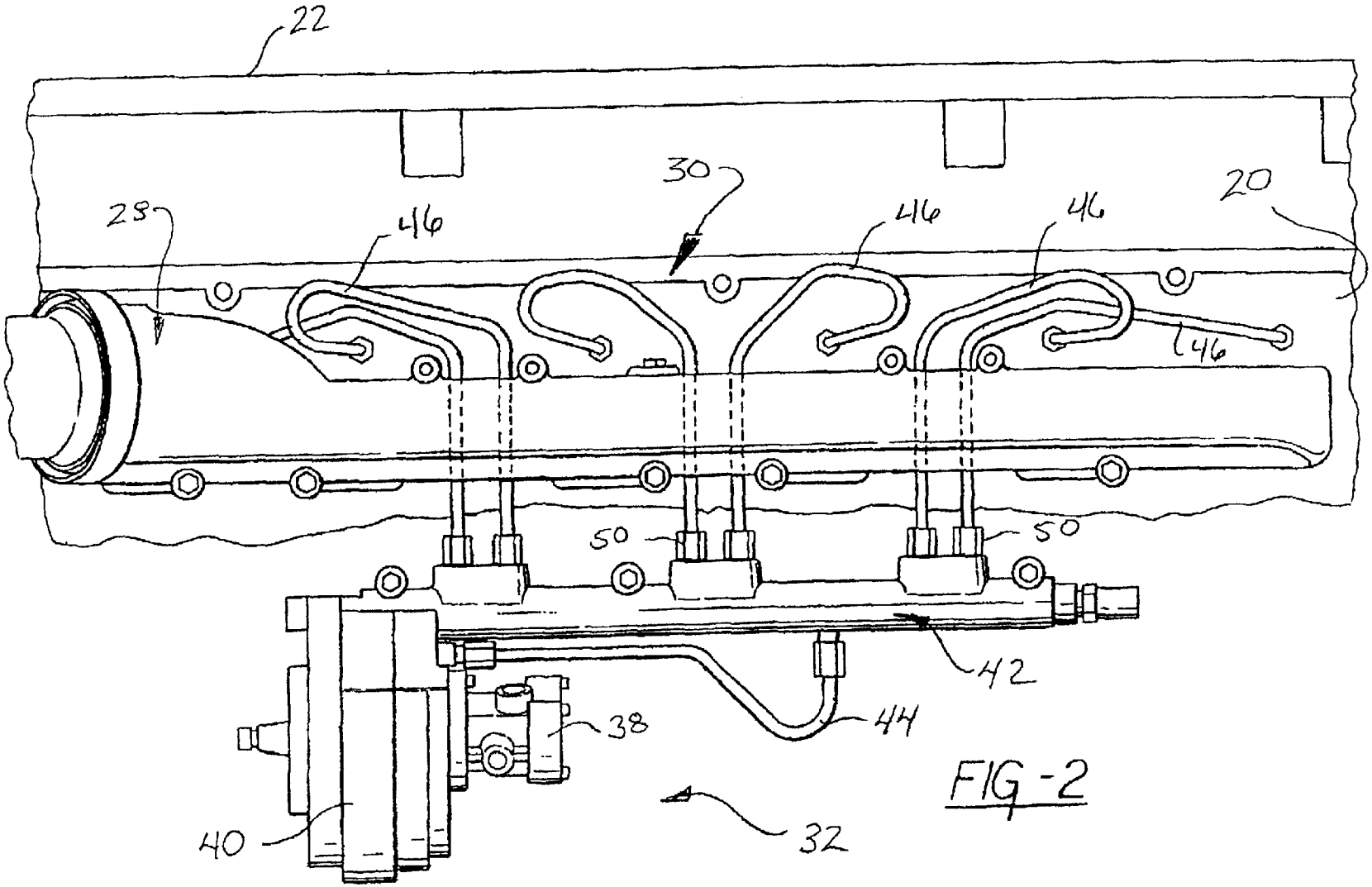
FIG. 2 is a partial side view illustrating a portion of the fuel injection system of the present invention.
Figure 4:
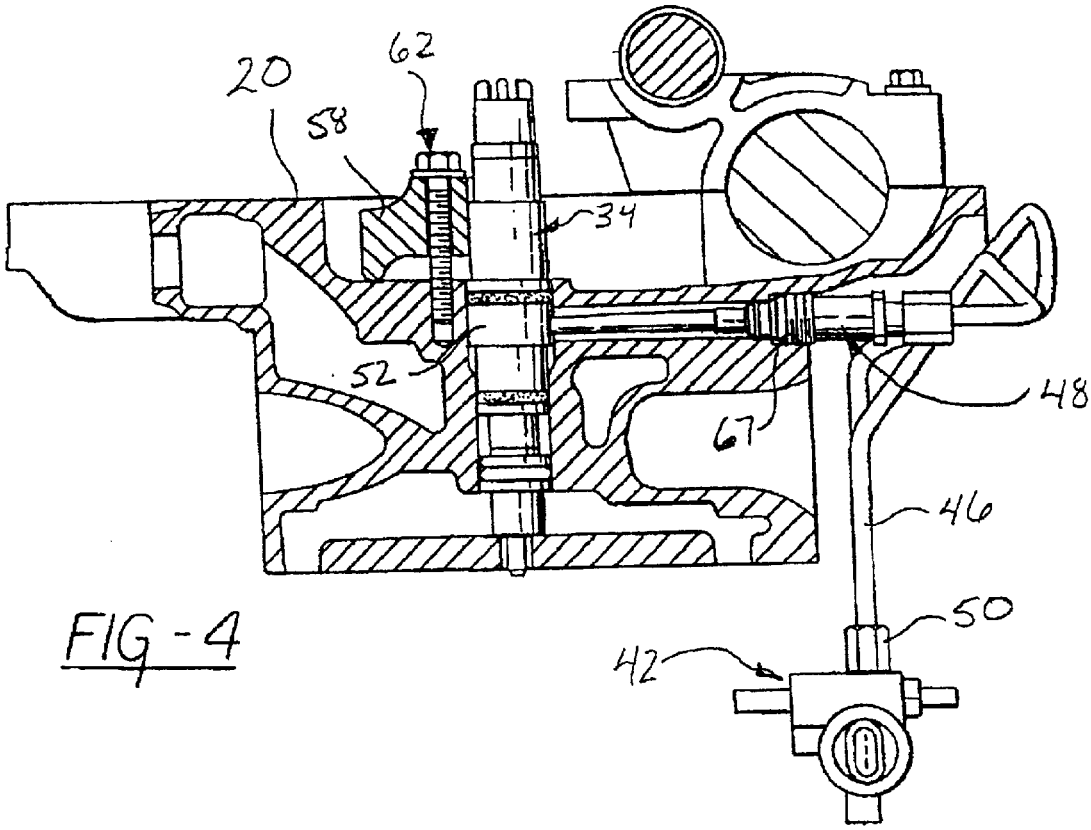
FIG. 4 is a partial cross-sectional side view of the fuel injection system of the present invention mounted relative to the cylinder head.
Figure 5:
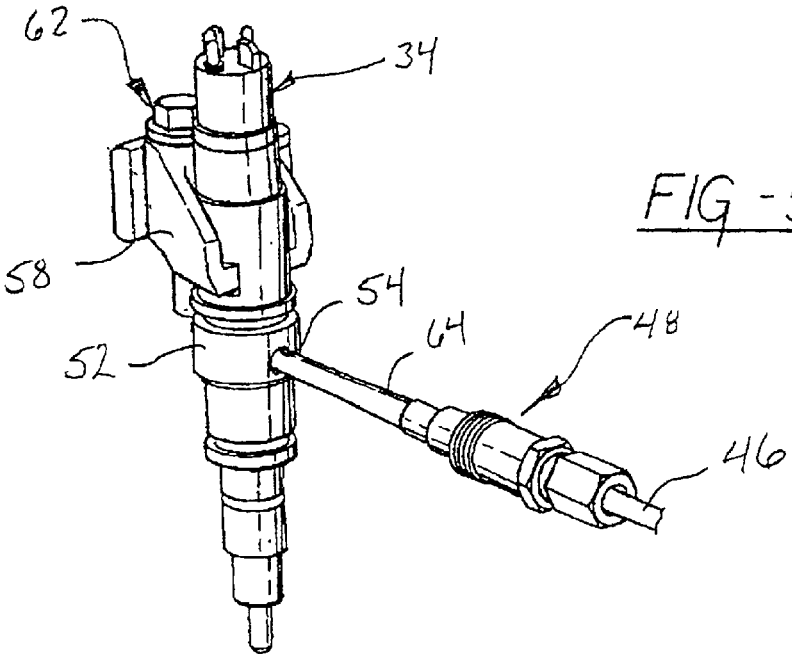
FIG. 5 is a partial perspective view showing the high-pressure connector of the present invention in fluid communication with the injector.
Figure 6:
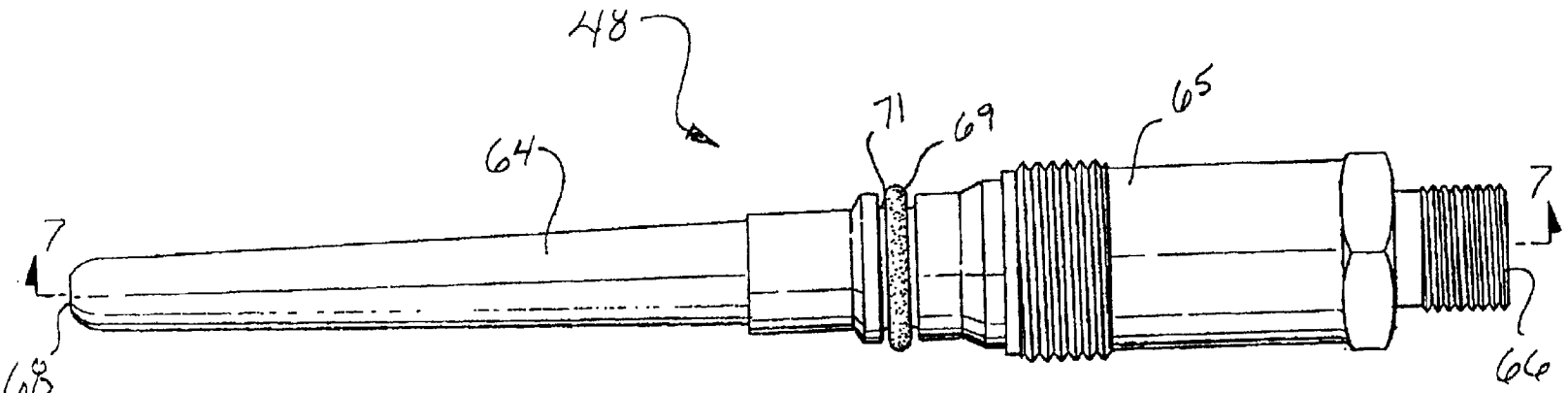
FIG. 6 is a side view of the high-pressure connector of the present invention.

The internal combustion engine 10 further includes a fuel injection system, generally indicated at 30 (FIG. 2), for proving high-pressure fuel to the combustion chambers 18. To this end, the fuel injection system 30 includes a source of high-pressure fuel, generally indicated at 32, and one or more fuel injectors, generally indicated at 34 in FIGS. 3–5, that correspond to each of the combustion chambers 18. The fuel injectors 34 are operatively supported by the cylinder head 20 for providing predetermined quantities of fuel into the combustion chambers 18 as will be described in greater detail below. In addition and referring again to FIG. 2, the fuel injection system 30 employs a low-pressure pump, generally indicated at 38, to deliver fuel from a fuel tank (not shown) to a high-pressure pump, generally indicated at 40. The low-pressure pump 38 may be a positive displacement pump of the type having intermeshing lobed gears, as is commonly known in the art. The low-pressure pump 38 is in fluid communication with the high-pressure pump 40. Like the low-pressure pump, the high-pressure pump 40 is a positive displacement type device, but typically uses a piston as its operative pumping member. The high-pressure pump 40 accepts low-pressure fuel from the low-pressure pump 38, elevates the pressure of the fuel and delivers high-pressure fuel to a fuel rail, generally indicated at 42, through a supply line 44. In turn, the fuel rail 42 distributes high-pressure fuel to each injector 34 via jumper lines 46 and high-pressure connectors, generally indicated at 48 in FIGS. 3–6. More specifically, the jumper lines 46 are operatively connected to the fuel rail 42 via fittings 50 as is commonly known in the art. High-pressure fuel flows through the jumper lines 46 to each injector 34 via the high-pressure connectors 48 as will be described in greater detail below.

As noted above, in the embodiment illustrated herein, each combustion chamber 18 has a corresponding injector 34 that is supported by the cylinder head 20. The injector 34 has a body 52 having an inlet 54 that is adapted for fluid communication with high-pressure fuel via the high-pressure connector 48. The injector 34 may be supported by an injector tube 56 (FIG. 3) that orients the injector 34 relative to the respective combustion chamber 18. A clamp 58 cooperates with a slot 60 on the injector body 52. A fastening system, generally indicated at 62, such as a screw and associated washer, securely mounts the clamp 58 and therefore the injector 34 to the cylinder head 20. The injector 34 may be of any known type designed to deliver a predetermined metered amount of fuel in the combustion chamber at preselected intervals. To this end, the injector 34 may often be controlled by an on-board engine controller system, not shown but as commonly known in the art. From the description that follows, those having ordinary skill in the art will appreciate that the specific interworkings of the injector form no part of the present invention.

As noted above, the fuel injection system of the present invention also includes a high-pressure connector, generally indicated at 48 in FIGS. 3–7. Referring now specifically to FIGS. 6–9, the high-pressure connector 48 includes an elongated body 64 having an inlet 66 that is in fluid communication with a source of high-pressure fuel via the jumper lines 46 as mentioned above. The high-pressure connector 48 also includes a outlet 68 that is in fluid communication with the inlet 54 of its associated fuel injector 34 and a fuel passage, generally indicated at 70, that extends between the inlet 66 and the outlet 68 for providing a flow path for high pressure fuel therebetween. The high-pressure connector 48 may also include a threaded adapter 65 disposed about the body 64 and that is adapted to threadably mount the connector in a corresponding tapped bore 67 (FIG. 4) formed on the cylinder head 20 of the internal combustion 10 in such a way that the outlet 68 is in sealing engagement with the corresponding inlet 54 to the associated injector 34. An O-ring 69 may be disposed in an annular groove 71 formed about the outer periphery of the elongated body 64 of the high-pressure connector to effect an air-tight seal between the connector 48 and the cylinder head 20. The high-pressure connector also includes a filter, generally indicated at 72, that is supported within the fuel passage 70. The filter 72 is integrated into the high-pressure connector 48 and acts to filter particulates from the high-pressure fuel.

In addition, the high-pressure connector of the present invention also includes a fuel flow limiter, generally indicated at 74, that is supported within the fuel passage 70. The fuel flow limiter 74 is operable to provide predetermined quantities of fuel between the inlet 66 and the outlet 68 through the fuel passage 70 at each injection event during normal operation of the combustion chamber 18 serviced by the injector 34. In addition, the fuel flow limiter 74 is operable to automatically terminate fuel flow between the inlet 66 and the outlet 68 and to the injector 34 in the event of a malfunction at the combustion chamber 18 as will be described in greater detail below.

The fuel passage 70 includes a main fuel passage 76 and a plenum chamber 78 that is defined between the main fuel passage 76 and the inlet 66 to the high-pressure connector 48. The fuel flow limiter 74 is moveably supported in the plenum chamber 78 among a first position (FIG. 7) wherein high-pressure fuel is collected within the plenum chamber 78, a second position (FIG. 8) at which a predetermined quantity of high-pressure fuel is delivered from the plenum chamber 78 to the outlet 68 of the high-pressure connector 48 and a third position (FIG. 9) that terminates fuel flow between the inlet 66 and the outlet 68 of the high-pressure connector 48 to the injector 34 in the event of a malfunction at the combustion chamber. The movement of the fuel flow limiter 74 within the plenum chamber 78 will be described in greater detail below. The malfunction at the combustion chamber can be of any type and may be related to a failure of the injector per se as well as any other component that results in a failure of a combustion event.

The fuel flow limiter 74 includes a body 80 and a nipple 82 extending from the body 80. The nipple 82 includes at least one, but preferably a plurality of orifices 84 that are in fluid communication with a high-pressure flow path 88 extending through the body 80 of the fuel flow limiter 74. The high-pressure flow path 88 forms a portion of the fuel passage 70 extending between the inlet 66 and the main fuel passage 76 of the high-pressure connector 48. Furthermore, the distal end of the nipple 82 defines a shut-off valve portion 86 as will be described in greater detail below.

Figure 7:
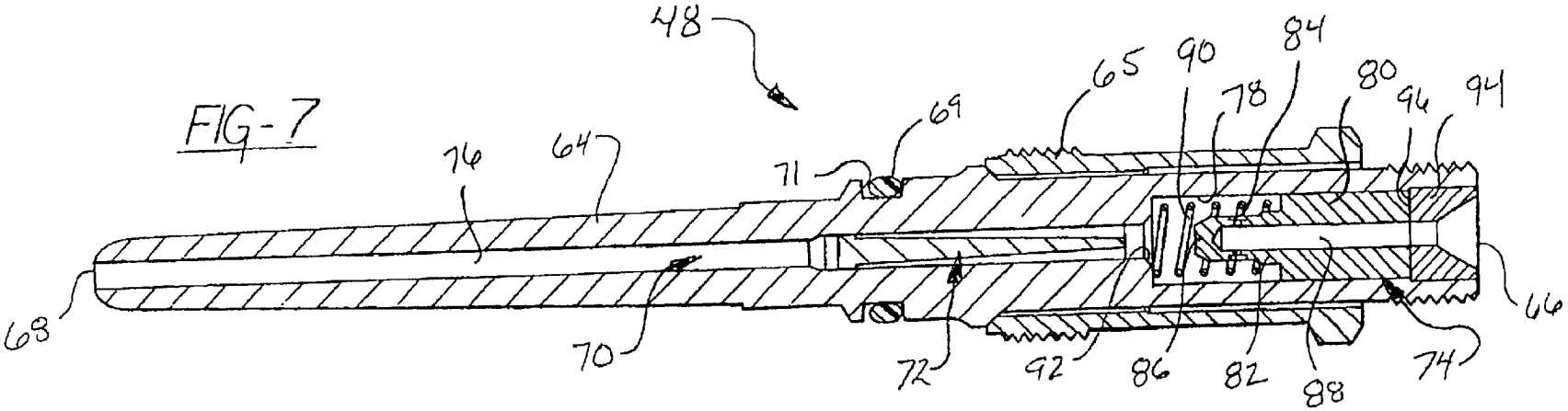
FIG. 7 is a cross-sectional side view of the high-pressure connector of the present invention taken substantially along the lines 7—7 of FIG. 6 and illustrating the fuel flow limiter in its first position.

A biasing member 90 is supported within the plenum chamber 78 and is operable to bias the body 80 of the fuel flow limiter 74 to the first position shown in FIG. 7. In the preferred embodiment disclosed herein, the biasing member 90 is a coiled spring. However, those having ordinary skill in the art will appreciate that the biasing member may take many forms and, within the scope of the appended claims, is not limited to a coiled spring.

Figure 9:
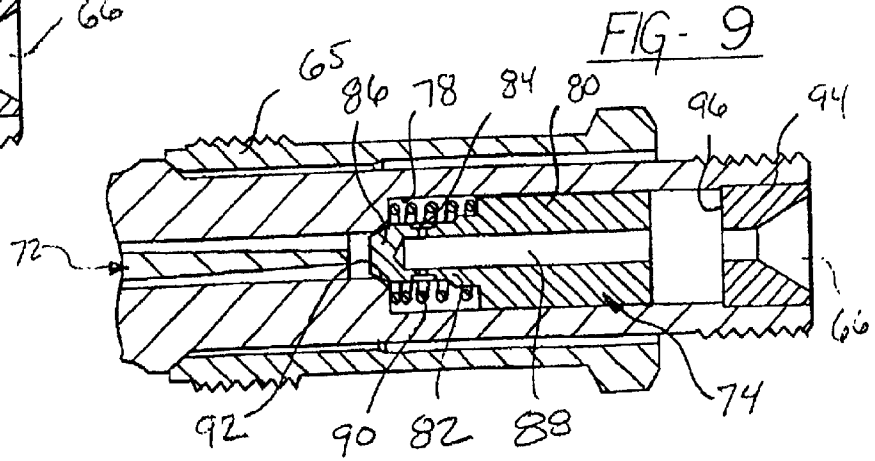
FIG. 9 is an enlarged, partial cross-sectional side view of the high-pressure connector of the present invention shown in FIG. 7 and illustrates the fuel flow limiter in its third position.

A valve seat 92 is defined at the juncture of the main fuel passage 76 and the plenum chamber 78. The fuel shut-off valve portion 86 of the nipple 82 cooperates with the valve seat 92 to terminate fuel flow through the high-pressure connector when the body 80 of the fuel flow limiter is in the third position as illustrated in FIG. 9. In one preferred embodiment, the high-pressure connector 48 also includes a retainer bushing 94 that is supported within the body 64 of the high-pressure connector 48. The retainer bushing 94 defines the inlet 66 to the high-pressure connector 48. The inlet 66 may be conically shaped for facilitating a tightly sealed connection with the jumper line 46 thereby establishing fluid communication between the source of high-pressure fuel 32 and the high-pressure flow path 88 extending through the body 80 of the fuel flow limiter 74. The retainer bushing 94 may include a stop surface 96 that is formed thereon opposite to the conical inlet 66. The stop surface 96 is adapted for abutting contact with one end of the body 80 of the fuel flow limiter 74. In this way, the stop surface 96 acts to define the first position of the fuel flow limiter 70 wherein high-pressure fuel is collected within the plenum chamber 78.

Figure 10:
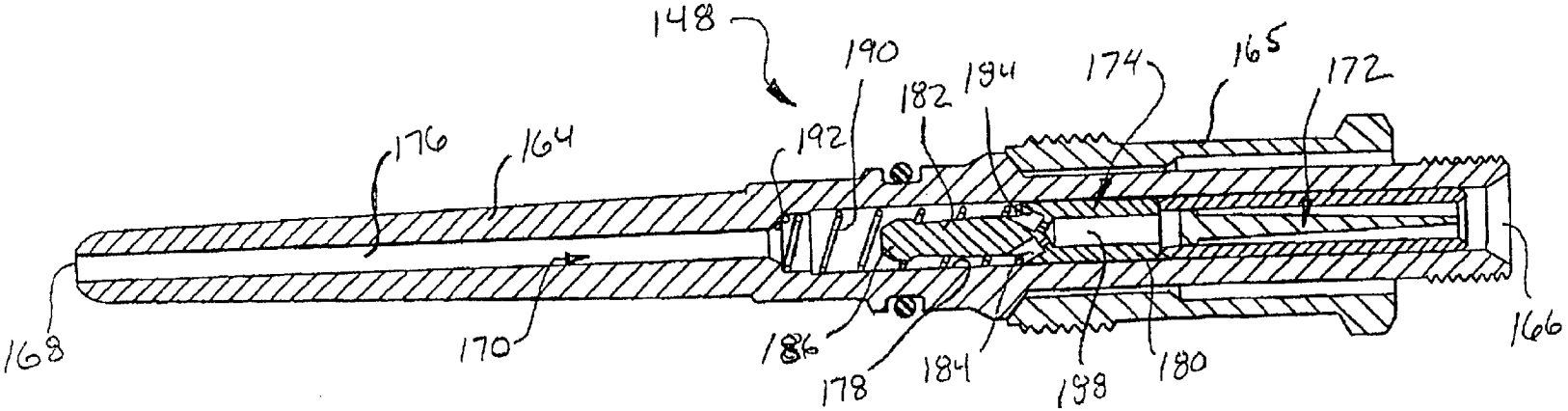
FIG. 10 is a cross-sectional side view of an alternate embodiment of the high-pressure connector of the present invention where the edge filter is disposed upstream of the fuel flow limiter.
Figure 8:
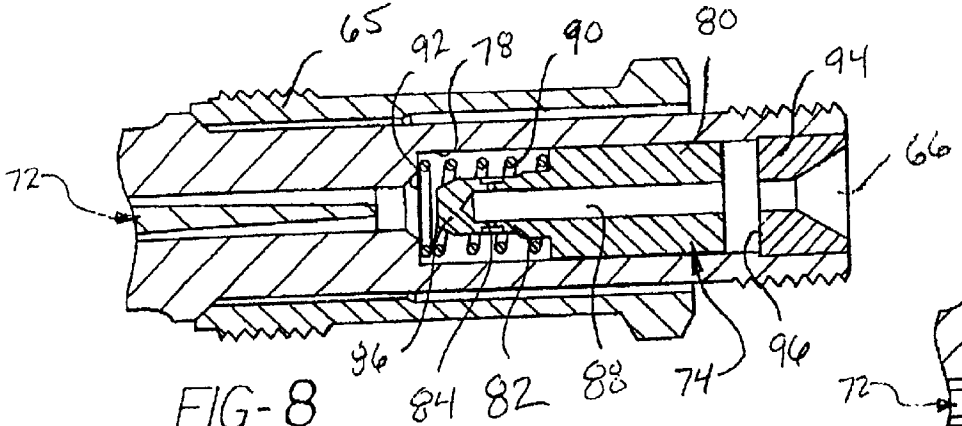
FIG. 8 is an enlarged, partial cross-sectional side view of the high-pressure connector of the present invention shown in FIG. 7 and illustrates the fuel flow limiter in its second position.

As noted above, the high-pressure connector 48 of the present invention also includes an integrated filter 72. Preferably, the filter 72 is an elongated edge type filter mounted in the main fuel passage 76 between the valve seat 92 and the outlet 78. An edge type filter 72 mounted in this way is illustrated in FIGS. 7–9. However, an alternate embodiment of the high-pressure connector 148 of the present invention is illustrated in FIG. 10 where like numerals, increased by 100, are used to designate like structure with respect to the embodiment illustrated in FIGS. 7–9. In this embodiment, the edge type filter 172 is mounted between the inlet 166 of the high-pressure connector 148 and the fuel flow limiter 174. Thus, in this embodiment, the edge filter 172 is disposed upstream of the fuel flow limiter 174 and acts to define the first position of the fuel flow limiter 174 in the same manner as that described with respect to the retainer bushing 94 above. In addition, the orifices 184 are disposed proximate to the base of the nipple 182 and distal to the shut off valve seat portion 186 formed on the opposite end thereof. Otherwise, the high-pressure connector 148 illustrated in FIG. 10 is substantially identical with respect to the high-pressure connector 48 illustrated in FIGS. 7–9. Accordingly, the description set forth with respect to FIGS. 7–9 applies in like manner with respect to the remaining components illustrated in FIG. 10 and designated with like reference numerals increased by 100.

OPERATION

The operation of the high-pressure connector of the present invention will now be described in greater detail with reference to the embodiment illustrated in FIGS. 7–9. However, those having ordinary skill in the art will appreciate that this description is also applicable to the embodiment illustrated in FIG. 10. High-pressure fuel flows through the inlet 66 defined at the bushing 94 through the high-pressure flow path 88 defined in the body 80 of the fuel flow limiter 74, out the plurality of orifices 84 and into the plenum chamber 78. The volume defined by the plenum chamber 78 is larger than the maximum volume of fuel of a single injection event. Prior to any injection event, the pressure in the plenum chamber 78 in combination with the biasing force generated by the biasing member 90 biases and the body 80 toward the retainer bushing 94 and against the stop surface 96. In this operative mode, the fuel flow limiter 74 is in its first position as illustrated in FIG. 7. During any given injection event, fuel is drawn from the plenum chamber 78 and the pressure in this chamber is reduced. The high pressure on the fuel delivery side of the body 80 causes a force imbalance on the body 80. The body 80 then moves to its second position under the influence of this force imbalance toward the valve seat 92 defined between the plenum chamber 78 and the main fuel passage 76 but does not move to the extent that the fuel shot off valve portion 86 engages the valve seat 92. The second position is illustrated in FIG. 8. After each injection event, the pressure in the plenum chamber 78 equalizes with the fuel supply pressure. Accordingly, the force of the biasing member 90 moves the body 80 back toward the retainer bushing 94 to its first position shown in FIG. 7.

In the event of a failure at the injector, pressure on the fuel delivery side of the body 80 exceeds the pressure in the plenum chamber 78 and causes the body 80 to move across the full volume of the plenum chamber 78 such the fuel shut off valve portion 86 of the nipple 82 seats against the valve seat 92 defined at the juncture of the main fuel passage 76 and the plenum chamber 78. This is the third position of the fuel flow limiter 74 and is illustrated in FIG. 9. In this way, the fuel delivery path between the fuel rail 42 and the fuel injector 34 is closed by the flow limiter 74, thereby operatively shutting down the injector 34.

The present invention incorporates the functionality of a high-pressure connector along with a fuel flow limiter and fuel filter in a single component of the fuel injection system. In this way, the high-pressure connector of the present invention results in a reduction of the number of components employed in the fuel injection system which results in a concomitant reduction and simplification of the mounting requirements necessary to employ the fuel injection system. In addition, the high-pressure connector of the present invention reduces the amount of space necessary to accommodate the fuel injection system and results in an overall simplification of the fuel injection system.

The invention has been described in an illustrative manner. It is to be understood that the terminology that has been used is intended to be in the nature of words of description rather than of limitation. Many modifications and variations of the invention are possible in light of the above teachings. Therefore, within the scope of the appended claims, the invention may be practiced other than as specifically described.

We claim:

1. A high-pressure connector for a fuel injection system of an internal combustion engine having combustion chambers serviced by fuel injectors, said high-pressure connector comprising:

an elongated body having an inlet that is in fluid communication with a source of high-pressure fuel, an outlet in fluid communication with the inlet of a fuel injector and a fuel passage extending between said inlet and said outlet for providing a flow path for high-pressure fuel therebetween, said fuel passage including a main fuel passage and a plenum chamber defined between said main fuel passage and said inlet to said high pressure connector;

a filter that is supported within said fuel passage and acts to filter particulates from the high-pressure fuel; and a fuel flow limiter moveably supported in said plenum chamber of said fuel passage among a first position wherein high pressure fuel is collected within said plenum chamber, a second position at which a predetermined quantity of high pressure fuel is delivered from said plenum chamber to said outlet of said high pressure connector at each injection event during normal operation of the combustion chamber serviced by the injector and a third position that terminates fuel flow between said inlet and said outlet of said high pressure connector and to the injector in the event of a malfunction at the combustion chamber.

2. A high-pressure connector as set forth in claim 1 wherein said fuel flow limiter includes a body, a nipple extending from said body, said nipple including at least one orifice and defining a shut-off valve portion at the distal end of said nipple, a high-pressure flow path extending through said body of said fuel flow limiter and in fluid communication with said orifice, said high-pressure flow path forming a portion of said fuel passage between said inlet and said main fuel passage of said high-pressure connector.

3. A high-pressure connector as set forth in claim 2 wherein said nipple includes a plurality of orifices that provide fluid communication between said high-pressure flow path and said plenum chamber.

4. A high-pressure connector as set forth in claim 2 further including a biasing member supported within said plenum chamber and operable to bias said body of said fuel flow limiter to said first position.

5. A high-pressure connector as set forth in claim 2 further including a valve seat defined at the juncture of said main fuel passage and said plenum chamber, said fuel shut-off valve portion of said nipple cooperating with said valve seat to terminate fuel flow through said high-pressure connector when said body of said fuel flow limiter is at said third position.

6. A high-pressure connector as set forth in claim 2 further including a retainer bushing supported by said body of said high-pressure connector and defining a conical inlet thereto for providing fluid communication between a source of high-pressure fuel and said high-pressure fuel path extending through said body of said fuel flow limiter.

7. A high-pressure connector as set forth in claim 6 wherein said retainer bushing includes a stop-surface formed thereon opposite to said conical inlet, said stop surface adapted for abutting contact with one end of said body of said fuel flow limiter so as to define said first position of said fuel flow limiter wherein high-pressure fuel is collected within said plenum chamber.

8. A high-pressure connector as set forth in claim 1 wherein said filter includes an elongated edge-type filter mounted in said main fuel passage between said valve seat and said outlet.

9. A high-pressure connector as set forth in claim 1 further including a threaded adapter disposed about said body of said high-pressure connector and adapted to threadably mount said high-pressure connector to a cylinder head of the internal combustion engine such that said outlet of said high-pressure connector is in sealing engagement with a corresponding inlet to the injector.

10. A fuel injection system for an internal combustion engine having combustion chambers serviced by fuel injectors, said fuel injection system comprising:

a source of high-pressure fuel, a fuel injector operatively supported on the internal combustion engine for providing predetermined quantities of fuel into the combustion chambers and a high-pressure connector;

said high-pressure connector including an elongated body having an inlet that is in fluid communication with said source of high-pressure fuel, an outlet in fluid communication with the inlet of said fuel injector and a fuel passage extending between said inlet and said outlet for providing a flow path for high-pressure fuel therebetween, said fuel passage including a main fuel passage and a plenum chamber defined between said main fuel passage and said inlet to said high pressure connector;

a filter that is supported within said fuel passage and acts to filter particulates from the high-pressure fuel; and a fuel flow limiter moveably supported in said plenum chamber of said fuel passage among a first position wherein high pressure fuel is collected within said plenum chamber, a second position at which a predetermined quantity of high pressure fuel is delivered from said plenum chamber to said outlet of said high pressure connector at each injection event during normal operation of the combustion chamber serviced by said injector and a third position that terminates fuel flow between said inlet and said outlet of said high pressure connector and to the injector in the event of a malfunction at the combustion chamber.

11. A fuel injection system as set forth in claim 10 wherein said fuel flow limiter includes a body, a nipple extending from said body, said nipple including at least one orifice and defining a shut-off valve portion at the distal end of said nipple, a high-pressure flow path extending through said body of said fuel flow limiter and in fluid communication with said orifice, said high-pressure flow path forming a portion of said fuel passage between said inlet and said main fuel passage of said high-pressure connector.

12. A fuel injection system as set forth in claim 11 further including a biasing member supported within said plenum chamber and operable to bias said body of said fuel flow limiter to said first position.

13. A fuel injection system set forth in claim 11 further seat defined at the juncture of said main fuel passage and said plenum chamber, said fuel shut-off valve portion of said nipple cooperating with said valve seat to terminate fuel flow through said high-pressure connector when said body of said fuel flow limiter is at said third position.

14. A fuel injection system as set forth in claim 11 further including a retainer bushing supported by said body of said high-pressure connector and defining a conical inlet thereto for providing fluid communication between said source of high-pressure fuel and said high-pressure fuel path extending through said body of said fuel flow limiter, said retainer bushing including a stop-surface formed thereon opposite to said conical inlet, said stop surface adapted for abutting contact with one end of said body of said fuel flow limiter so as to define said first position of said fuel flow limiter wherein high-pressure fuel is collected within said plenum chamber.

15. A fuel injection system as set forth in claim 10 wherein said filter includes an elongated edge-type filter mounted in said main fuel passage between said valve seat and said outlet.

16. An internal combustion engine comprising:

an engine block having a plurality of cylinders with a corresponding piston reciprocally supported in each one of said cylinders so as to define combustion chambers within said engine block, a cylinder head mounted to said engine block;

a fuel injection system for providing high-pressure fuel to said combustion chambers, said fuel injection system including a source of high-pressure fuel, a fuel injector corresponding to each of said combustion chambers and operatively supported by said cylinder head for providing predetermined quantities of fuel into said combustion chambers, and a high-pressure connector;

said high-pressure connector including an elongated body having an inlet that is in fluid communication with said source of high-pressure fuel, an outlet in fluid communication with the inlet of said fuel injector and a fuel passage extending between said inlet and said outlet for providing a flow path for high-pressure fuel therebetween, said fuel passage including a main fuel passage and a plenum chamber defined between said main fuel passage and said inlet to said high pressure connector;

a filter that is supported within said fuel passage and acts to filter particulates from the high-pressure fuel; and a fuel flow limiter moveably supported in said plenum chamber of said fuel passage among a first position wherein high pressure fuel is collected within said plenum chamber, a second position at which a predetermined quantity of high pressure fuel is delivered from said plenum chamber to said outlet of said high pressure connector at each injection event during normal operation of the combustion chamber serviced by said injector and a third position that terminates fuel flow between said inlet and said outlet of said high pressure connector and to the injector in the event of a malfunction at the combustion chamber.

17. An internal combustion engine as set forth in claim 16 wherein said fuel flow limiter includes a body, a nipple extending from said body, said nipple including at least one orifice and defining a shut-off valve portion at the distal end of said nipple, a high-pressure flow path extending through said body of said fuel flow limiter and in fluid communication with said orifice, said high-pressure flow path forming a portion of said fuel passage between said inlet and said main fuel passage of said high-pressure connector.

* * * * *